US005592804A

United States Patent [19]

Reuteler

[11] Patent Number: 5,592,804

[45] Date of Patent: Jan. 14, 1997

[54] METHOD AND APPARATUS FOR POSITIONING CARTON FLAPS

[75] Inventor: Urs Reuteler, Kennesaw, Ga.

[73] Assignee: Riverwood International Corporation, Atlanta, Ga.

[21] Appl. No.: 549,988

[22] Filed: Oct. 30, 1995

[51] Int. Cl.[6] ..... B65B 21/00; B65B 21/24; B65B 27/04

[52] U.S. Cl. ..... 53/398; 53/48.7; 53/48.9

[58] Field of Search ..... 53/398, 48.7, 48.8, 53/48.9, 377.2, 378.3, 387.2

[56] References Cited

U.S. PATENT DOCUMENTS

| | | | |
|---|---|---|---|
| 3,045,401 | 7/1962 | Ganz | 53/48.9 |
| 3,197,937 | 8/1965 | Ganz | 53/48.9 |
| 3,303,631 | 2/1967 | Ganz | 53/48.9 X |
| 3,572,003 | 3/1971 | Perry et al. | 53/48.7 X |
| 4,285,185 | 8/1981 | Collura et al. | 53/48.7 |
| 4,554,778 | 11/1985 | Calvert | 53/48.7 X |
| 4,612,753 | 9/1986 | Taylor et al. | 53/398 |
| 4,970,843 | 11/1990 | Louret et al. | 53/48.7 |

*Primary Examiner*—Horace M. Culver

[57] ABSTRACT

A carton flap folding assembly (10) and a method of folding carton flaps is disclosed. The carton flap folding assembly includes a modular housing (12) positioned on the framework (22) of a packaging machine, and along the path of travel of articles of product moved along the packaging machine. The carton flap folding assembly includes a drive gear (26) which moves a drive pulley (28) and a star wheel assembly (29) in a timed relationship with respect to one another and with the groups of articles of product conveyed along a path of travel past the assembly. A spaced series of generally protruding lugs (33) are formed along the length of an endless lug belt (32), and a top star wheel disc (84) and a spaced bottom star wheel disc (85), each having a spaced series of generally protruding teeth (86) formed thereon are also provided as a part of the carton blank flap folding assembly. The teeth of the star wheel discs are moved into the prescored flap areas of a carton blank to break the flaps open, whereupon lugs from the lug belt are moved into the carton blank through the prescored flap areas, moving the flaps thereof into tangential engagement with the exterior surface of the bottles within the group of bottles, the side wall of the carton blank being simultaneously moved toward the bottles by a top guide (90) and a bottom guide (91).

24 Claims, 8 Drawing Sheets

METHOD AND APPARATUS FOR POSITIONING CARTON FLAPS

FIELD OF THE INVENTION

This invention relates in general to packaging machinery. More particularly, this invention relates to a method and apparatus for folding the bottle reinforcing and stabilizing flaps of wrap-around cartons for beverage containers. The invention is ideally suitable for use in a continuous motion packaging machine which engages a carton blank positioned on a group of bottles moving along a path of travel through the packaging machine.

BACKGROUND OF THE INVENTION

Continuous motion packaging machines, including those machines which package articles such as beverage containers or food containers, are well known. These continuous motion packaging machines typically group a selected number of articles into a desired configuration, for example a six pack configuration, then package the articles into a carton or carder formed from a paperboard blank. When packaging bottled or canned beverages, for example, the articles are grouped and either moved singularly or as a group into an open, preassembled carton, at which point the carton is sealed. In another configuration, a wrap-around paperboard carton blank is folded or wrapped around the preconfigured article group, and then sealed so that the packaged articles are ready for shipment.

Whichever type of carton is used, the packaging of the article group into the paperboard carton blank occurs while the article or articles are passed from an infeed area along a path of travel through a packaging machine, and to an outfeed area. This allows the articles to be packaged in a continuous operation, which normally carries on without interruption.

Many types of paperboard carders, including the wrap-around type, are manufactured of paperboard carton blanks which include fold lines, score lines, and preformed flaps. These flaps act as article stabilizers or reinforcing members for the articles enclosed within the paperboard blank as it is formed into a carton or carrier. The reinforcing flaps serve to restrict article movement and to prevent contact of adjacent articles once the carrier has been wrapped around the article group and tightened or locked, which is usually accomplished by placing a tab formed on one portion of the paperboard blank into an aperture formed in an adjacent bottom panel. A typical reinforcing flap, therefore, would merely be a portion of the side panel of the paperboard carrier defined by partial cuts or score lines.

Thus, when paperboard carton blanks are used for packaging articles the reinforcing flap is a part of, and is aligned with, the sidewall of the carton blank. As the paperboard carrier or carton blank is wrapped around a bottle group, however, the reinforcing flap is not automatically biased into its final position in which it will project inwardly from the sidewall and into the bottle group. The flap must be moved into the appropriate orientation by a separate mechanism.

An advantage of packaging articles into paperboard carriers is to utilize the carrier for advertising and/or promotional purposes, so that it forms a display or advertisement. Thus, it is important that when forming the carton blank around the articles of product, that the paperboard carrier not be torn or damaged. If the paperboard carrier becomes torn or damaged, not only will the package fail to secure the articles in position within the carrier, the carrier will also lose its aesthetic appeal. Thus, it is of paramount concern that not only is the paperboard carrier properly formed around the articles, it is also important that this be accomplished in a manner which does not damage the paperboard carrier and/or the advertising carried thereon.

A number of flap folding mechanisms have been developed for use in packaging machines to bend or fold the reinforcing flaps of the paperboard carrier into the proper orientation. The step of folding or bending the reinforcing flaps usually occurs just prior to the tightening and closure of the paperboard carrier around the bottle group. In many of these operations, the packaging mechanism must engage a specific area of the carton blank in a particular manner in order to accomplish the desired step of folding the flaps of the carrier inwardly for locking the bottles into position. It also must be kept in mind that this operation is performed while the carton blank is in a continuous motion path of travel, often at a high speed, through a packaging machine. Thus, the folding mechanism must be specifically designed to operate in timed relationship with the moving carton blanks. In addition, such wrap-around cartons may include several flaps, perhaps as many as two or three flaps per side, all of which must be folded to reinforce and separate adjacent articles of product within the carton blank.

In the past, the task of folding the reinforcing flaps of carton blanks was done by flap folding mechanisms which included numerous mechanical engaging devices that were sequentially aligned with the prescored flap areas of the carton blank sidewall and moved into the carton blank to fold the flaps to a first position. The folding mechanism then mechanically folded the flaps even further, so that the flaps would not spring back into a position in which they would become closed on the carton blank sidewall when engaging the articles within the carton blank. A problem associated with these flap folding devices, however, was that the activation of the engagement device to fold the flaps to the furthest extent within the carton blank often resulted in the shifting of the entire carton blank in the direction of the path of travel, which would result in the misalignment of the carton blank within the other flap folding devices.

Since the transverse alignment of a moving carton blank with the engagement mechanism of a flap folding device is important, carton blank shifting can have a significant effect on the entire packaging operation. If a carton blank is shifted sufficiently, subsequent engagement mechanisms will not appropriately align with the prescored flap areas, and the remaining and sequentially positioned engagement mechanisms will impact the carton blank sidewall at a position other than that where a prescored flap area is defined, resulting in the bending or tearing of the carton blank. When this occurs in a high speed packaging operation, the entire process flow is interrupted, which not only causes the packaging machine to shut down, but shuts down the entire packaging line also.

Moreover, with the development of packaging machines capable of processing articles of different sizes, diameters, and article group configurations, attention has been focused on the development of modular article engagement mechanisms, to include reinforcing flap folding devices. This has been done in order to allow for quicker changeover of the folding device needed for particular carton designs. Prior to the development of modular folding devices, article engagement devices were typically carried on or in a continuous chain or belt moving in timed relationship with the group of articles along the path of travel. Such an arrangement, however, does not provide the flexibility needed in modem packaging operations, and is not readily adapted for use with contemporary and multi-configurable packaging machinery.

One example of a prior art machine is disclosed in U.S. Pat. No. 4,563,8532 Calvert. The device of Calvert is mounted on an endless chain conveyor which is driven along the carton blank's path of travel and is aligned, and moved in timed relation, with specific areas of the carton blank. One problem with this type of arrangement, however, lies in the fact that this type of system is not readily interchangeable or adjustable to accommodate various carton blank sizes or shapes which can be processed on modern multi-configurable packaging machines. Changing over to engage different types or sizes of cartons will require the disassembly and reassembly of the entire conveyor system, or the inclusion of a chain phasing mechanism, not taught in Calvert. Calvert accomplishes the folding of the flaps by introducing a stud into the prescored flap area, on which a pair of flap folding elements are pivotally mounted and moved to engage the reinforcing flaps for folding the flaps inwardly in relation to the bottles in the group of bottles being packaged.

A similar approach is disclosed in U.S. Pat. No. 4,970,843 to Louret et al. The mechanism of Louret et al is carried by a chain conveyor, and is adapted to sequentially engage the prescored flap areas of a carton blank, and to sequentially fold the carton flaps through the movement of a pair of pivotal folding arms which will open the flaps inwardly of the carton blank.

An example of a modular carton engaging mechanism is shown in U.S. Pat. No. 4,612,753 to Taylor et al. The device of Taylor includes one or more fingers which are urged into contact with locking tabs on the paperboard carrier to force the locking tabs through an opening on the carrier. The fingers may be actuated either by a rotating cam operating device, or may be electromagnetically actuated. These locking fingers are carried on a rotating wheel located in a stationary position along the path of travel of the packaging machine. Unlike the patents to Calvert and Louret et al, discussed above, however, the device of Taylor et al, includes a mechanically operable mechanism which must first be inserted into the prescored flap area of a carton blank, and then actuated to effect a folding of the flaps thereof.

A device similar to Taylor et al, is disclosed in PCT patent application No. PCT/US94/10787. The PCT application discloses a flap folding mechanism incorporated on a rotating wheel fixed in position with respect to a carton blank moved along the packaging line. The device of the PCT application discloses a folder having pivotal fingers for engaging and folding pairs of flaps formed in the carton blank sidewall and moved into the carton blank, whereupon the pivotal fingers are moved to open the flaps to a further extent.

While the modular carton engaging or flap folding mechanisms of Taylor et al, and the PCT application may appear to be more versatile than the prior art chain conveyor assemblies, all of the known flap folding devices, whether modular or driven along a chain conveyor, are adapted to sequentially engage adjacent prescored flap areas define in the sidewall of a carton blank, and to sequentially fold the flaps inwardly through a two step process in which a finger is first inserted into the carton blank sidewall, and then the finger is actuated to open the flaps to a further extent.

Thus, the known flap folding devices involve the steps of mechanically opening the flaps defined in a carton blank sidewall inwardly to a first extent, and then to a second extent. Moreover, the prior art devices all use moving probes or studs having mechanically actuated fingers which are inserted into the opening, opened, and retracted, whereupon the stud or probe is withdrawn from the prescored flap area.

SUMMARY OF THE INVENTION

The present invention provides an improved method and apparatus for positioning carton flaps which overcome some of the design deficiencies of other flap folding mechanisms known in the art. This is accomplished by providing a method in which a carton flap folding assembly is especially adapted to engage a carton, such as a paperboard carrier, at a specific area where a flap or flaps are prescored in the sidewall of the carton blank, and to fold the flap or flaps inwardly to a predetermined extent whereupon the flaps will pass over the exterior surface of the articles as the sidewall of the carton blank is moved toward the articles prior to locking the bottom flaps of the paperboard carrier together to enclose the articles within the paperboard carrier.

This improved method is adapted for use in folding the flaps of a packaging carton blank about a group of bottles as the carton blank and group of bottles are conveyed through a packaging machine along a predefined path of travel, in which the carton blank has at least one prescored flap area formed in its sidewall with respect to each bottle within the group of bottles.

The method disclosed herein includes the steps of positioning a carton flap folding assembly along the path of travel so that the carton blank passes in spaced relationship to the folding assembly as the articles are conveyed along the path of travel. The folding assembly inserts a pair of spaced star wheel teeth into the carton blank through the prescored flap area to break the flaps from the carton sidewall, and then inserts one lug of an endless lug belt to move the flaps inwardly toward the first of the bottles within the group of bottles as the sidewall of the carton blank is simultaneously being moved toward the group of bottles. The lug guides the flaps of the prescored flap area into tangential engagement with the exterior surface of the bottle as the sidewall of the carton blank is moved to close the carton blank about the articles of product. The flaps of the carton blank are fully opened by being moved tangentially across the exterior surface of the bottle. Once the flaps have traveled along the exterior of the bottles to the extent that they can no longer spring back into a closed position, each lug is removed, and the carton blank continues in the path of travel. This is done sequentially for each one of the bottles moved along the path of travel. This method thus provides a simple, yet reliable and efficient means for opening the flaps of the prescored flap area and securing the bottles inside the paperboard carrier prior to its being sealed closed.

The apparatus for practicing this invention includes a carton flap folding assembly positioned adjacent the path of travel and fixed in position with respect to a carton blank. The carton flap folding assembly includes a star wheel assembly having at least one star wheel with a spaced series of protruding teeth constructed and arranged to be inserted through the prescored flap areas and into the carton blank. The apparatus also includes a spaced series of lugs positioned on an endless lug belt extending along and parallel to the path of travel, the lugs being constructed to be inserted into the prescored flap area after the star wheel has broken the prescored flaps open as the carton blank proceeds past the carton flap folding assembly.

The star wheel assembly and endless lug belt are driven by a common drive gear, so that the endless lug belt and star wheel move in timed relationship with respect to one another, as well as with respect to the prescored flap areas defined in the sidewall of the carton blank as it moves along the path of travel. The apparatus also includes a lower carton blank guide and a spaced upper carton blank guide, which act to simultaneously move the sidewall of the carton blank toward the path of travel and the group of articles to be packaged while the lugs of the endless lug belt are being passed through the prescored flap areas. This ensures that the flaps tangentially engage the exterior surface of each bottle, and are passed across the surface of the bottle into their full open position in order to lock the bottles in position in the prescored carrier as it travels along the path of travel.

The star wheel assembly includes a hub which is rotatably supported within a modular housing for the carton flap folding assembly. Positioned on the star wheel hub, between spaced top and bottom star wheel discs is a belt driven pulley which rotates independently of the hub, and is driven by the endless lug belt. The lug belt is passed over the belt driven pulley as well as a separate drive pulley located within the modular housing of the carton flap folding assembly. Both the star wheel hub and the drive pulley for the endless lug belt are driven by a common drive gear so that the drive pulley and star wheel hub move in timed relationship with respect to each other, and thus the endless lug belt and the star wheel discs also move in a timed relationship with respect to one another.

Additional stabilization of the carton blank is affected since an identical folding assembly simultaneously performs the identical functions on the opposite side of the carton blank as it moves along the path of travel, thus ensuring that no transverse or lateral displacement of the carton blank occurs as the articles of product travel along the path of travel through the packaging machine. In addition, as the lugs do not have any separate fingers or mechanism which act to move the flaps inwardly, no shifting of the carton blank occurs when using the engagement mechanism of this carton flap folding assembly.

DETAILED DESCRIPTION OF THE DRAWINGS

DETAILED DESCRIPTION OF THE PREFERRED EMBODIMENT

Figure 1:
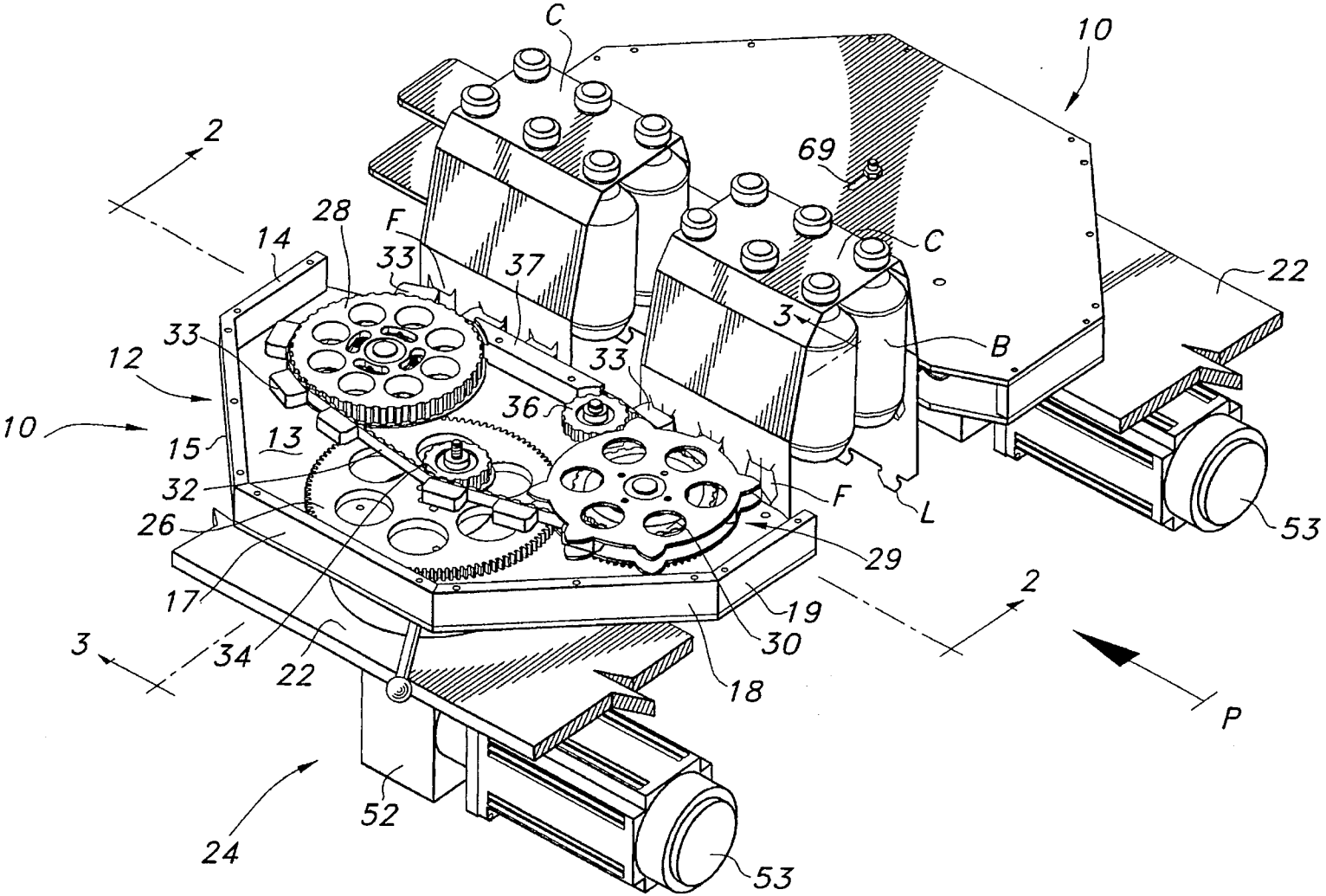
FIG. 1 is a perspective view of a preferred embodiment of the present invention positioned within a continuous motion packaging machine.

Referring now to the drawings, in which like reference numerals indicate like parts throughout the several views, FIG. 1 shows the present invention positioned along the carton placement area of a continuous motion beverage container packaging machine. A modular carton flap folding assembly 10 is shown in FIG. 1 positioned adjacent the path of travel P of the packaging machine. This type of packaging machine generally is well known in the art, and is of the type which groups beverage containers, such as bottles and cans, into a selected article group configuration. The article group, here bottles, is conveyed from an infeed area (not illustrated) positioned upstream of the carton placement area, then along the path of travel P past carton flap folding assembly 10, and then downstream toward an outfeed area (not illustrated).

In this type of packaging machine, a prescored, precreased, wrap-around carton blank C is placed over the article group, here a group of bottles B, as bottle group B and carton blank C are moved on a dead plate (not illustrated) downstream along path P by a packaging machine conveyor (not illustrated) and locked into position with respect to one another when the locking tabs L, formed in the carton bottom panels, are placed into coinciding apertures (not illustrated) defined in the matching bottom panel of the carton blank. Prior to locking the wrap-around carton securely around the article group, however, a plurality of carton reinforcing or bottle stabilizing and retaining flaps f (FIGS. 5A–5F) are folded inwardly toward the bottle group B disposed on the machine conveyor (not illustrated). Further, and as shown in FIG. 1, a pair of carton flap folding assemblies 10 will be stationed along path of travel P opposite one another so that each engages bottle group B and carton blank C simultaneously as it travels along path of travel P.

Figure 2:
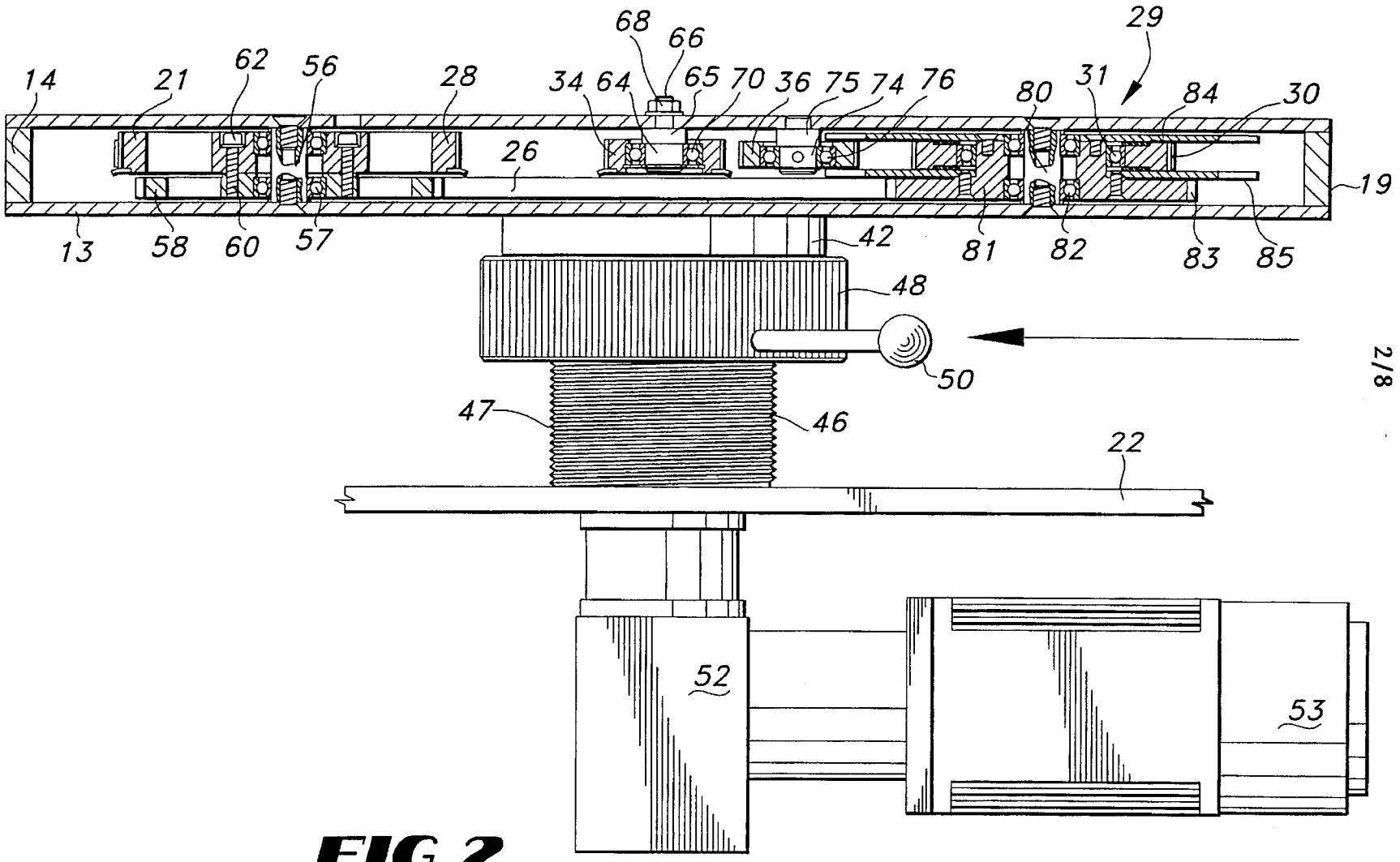
FIG. 2 is a cross-sectional side view of the present invention along line 2—2 of FIG. 1.
Figure 3:
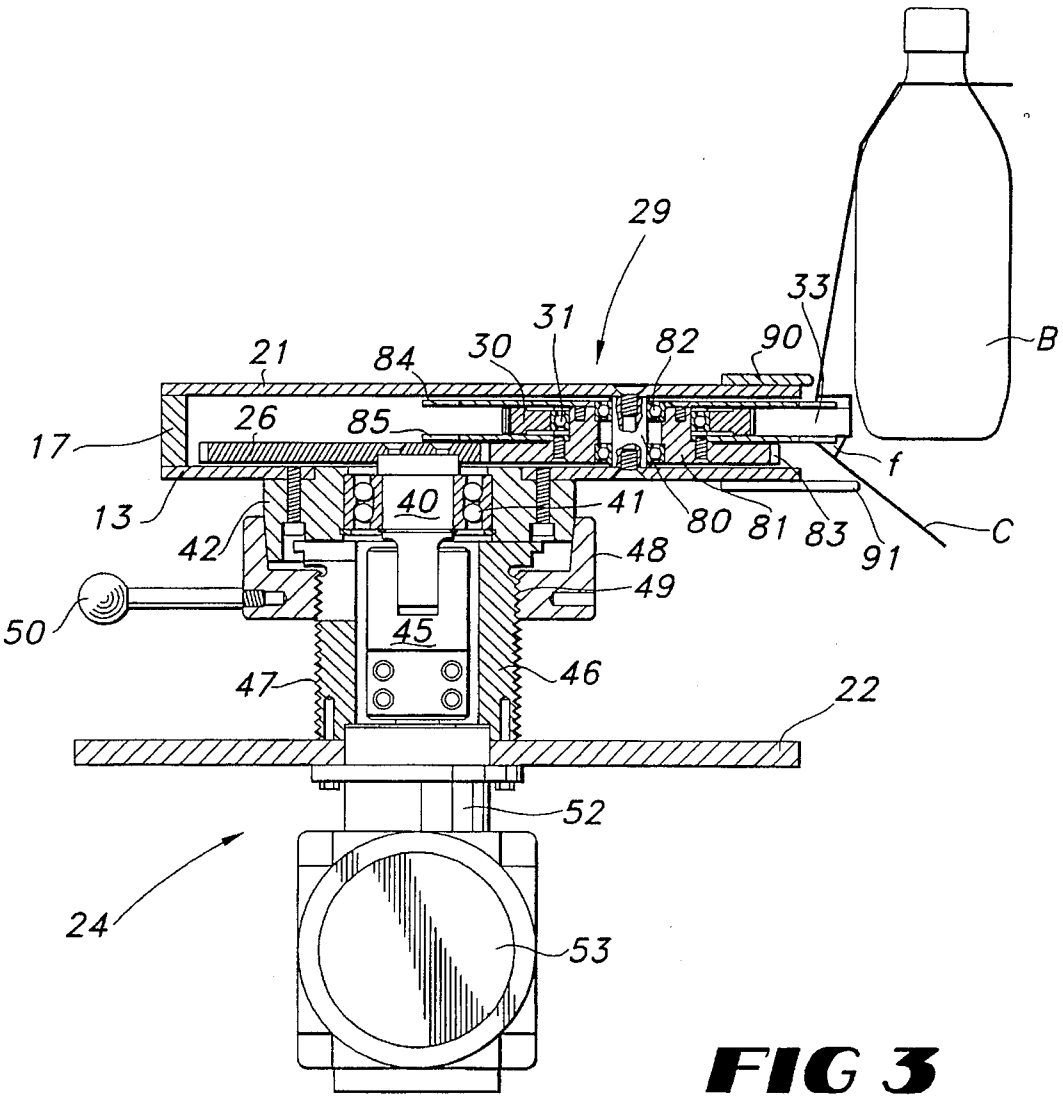
FIG. 3 is a cross-sectional end view of the present invention along line 3—3 of FIG. 1.

Turning now to FIGS. 1 through 4, carton flap folding assembly 10 is illustrated in greater detail. As shown in FIG. 1, the carton flap folding assembly includes a housing 12 having a generally horizontal bottom plate 13, a side plate 14 positioned at the downstream end of the path of travel P, and an angled side plate 15 extending therefrom toward side plate 17 positioned generally parallel to the path of travel. Attached to side plate 17 is an angled side plate 18 which extends toward side plate 19, side plate 19 being positioned on bottom plate 13 at the upstream end of the path of travel. A generally horizontal top plate 21, best shown in FIGS. 2 and 3, also forms a part of housing 12. The bottom plate, side plates, and top plate of the housing are connected to one another along their common edges to form a generally enclosed housing, with the exception of that portion of housing 12 positioned adjacent and along path of travel P, which is left open. As shown in FIG. 1, housing 10 is supported on framework 22 of the packaging machine (not illustrated) by drive assembly 24, and in particular by assembly mount 46 thereof, as best shown in FIGS. 2 and 3. Although housing 12 as disclosed herein includes five side plates, it is anticipated that housing 12 could just as well be generally rectangular or square. All that is required is that a housing for positioning the components of carton flap folding assembly 10 be provided.

Referring to FIG. 1, carton flap folding assembly 10 includes a drive gear 26 rotatably supported within housing 10, and spaced above bottom plate 13, a toothed drive pulley 28, a star wheel assembly 29, a toothed belt tightening pulley 34, and a toothed idler pulley 36, each toothed pulley being constructed to engage an endless toothed lug belt 32 passed thereover and extending between drive pulley 28 and a belt driven pulley 30 positioned on hub 81 (FIGS. 2 and 3) of the star wheel assembly. Belt driven pulley 30 is driven independently of star wheel assembly 29 by lug belt 32, rather than by rotating with the star wheel assembly so that belt drive pulley 30 rotates independently, or freely, of the rotation of star wheel assembly 29. Drive pulley 28, star wheel assembly 29, as well as pulleys 34 and 36, are each rotatably supported (FIGS. 2, 3) on housing 12. Lug belt 32 has a spaced series of generally protruding lugs 33 mounted thereon, or formed as a part thereof, lugs 33 being designed to be inserted into prestored flap areas F for folding the flaps f thereof inwardly into carton blank C, as described in greater detail below.

Lug belt 32 is passed over drive pulley 28, belt driven pulley 30, belt tightening pulley 34, and idler pulley 36. Only drive pulley 28 drives lug belt 32, the remainder of the pulleys serving only to support the lug belt for rotation.

Figure 6:
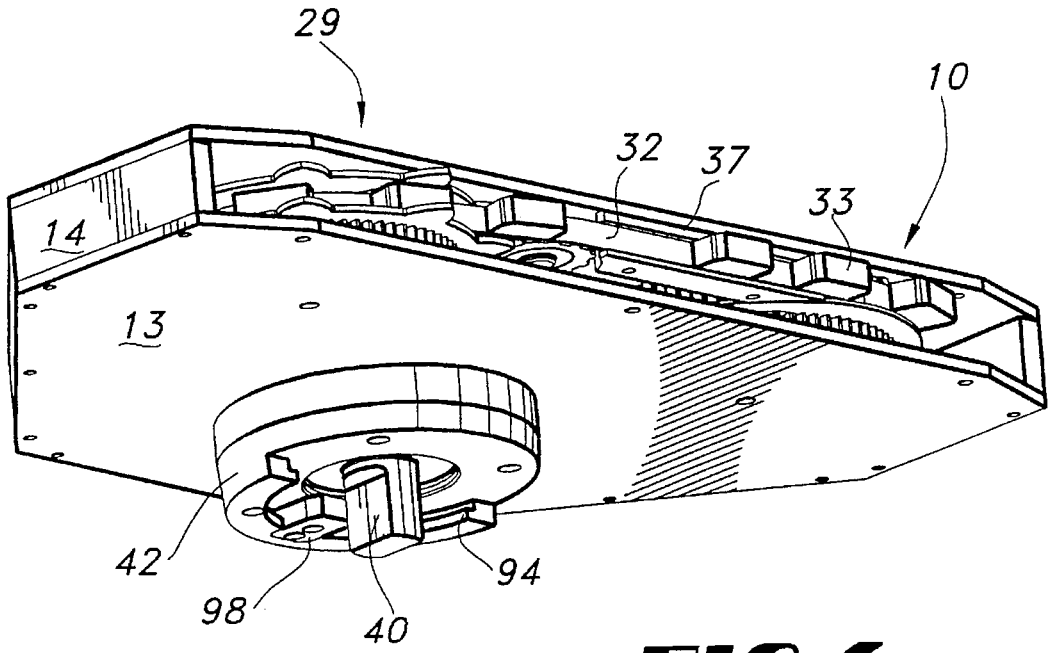
FIG. 6 is a bottom perspective view of the embodiment of FIG. 1 showing the modular construction of the present invention.
Figure 7:
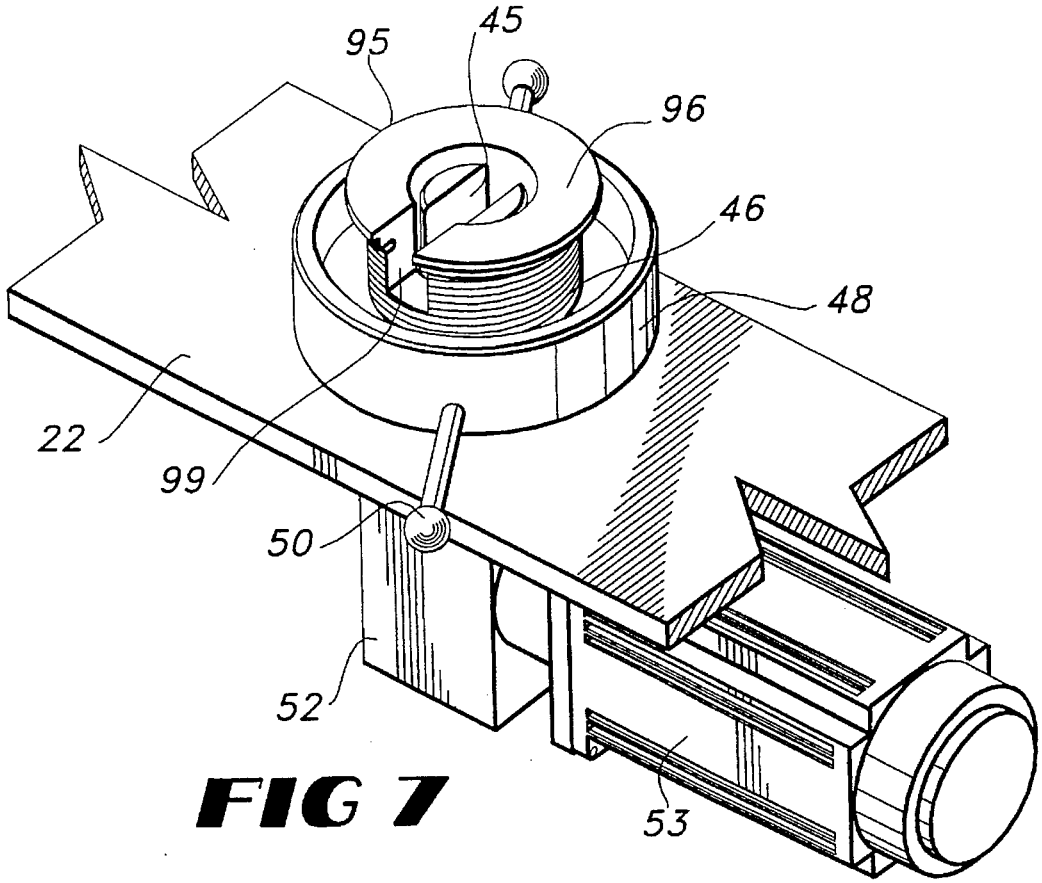
FIG. 7 is a top perspective view of the embodiment of FIG. 1 showing the modular connection point of the invention to the framework of the packaging machine.

Drive assembly 24 is illustrated in FIGS. 2 and 3, and in FIGS. 6 and 7. Turning first to FIG. 3, drive assembly 24 includes drive gear 26 mounted on a drive shaft 40, drive shaft 40 being rotatably supported on drive shaft bearings 41 mounted within drive shaft coupling 42. As best shown in FIGS. 3 and 6, drive shaft coupling 42 is tapered or chamfered along its length so that the drive shaft coupling is angled inwardly toward the vertical axis (not illustrated) extending through shaft 64 (FIG. 3), drive shaft 40, and drive coupling 45. A matching tapered or chamfered profile is formed along the inner periphery of locking nut 48 (FIGS. 3 and 7), for snugly receiving drive shaft coupling 42 therein as the locking nut is run up assembly mount 46 on threads 47, mating with threads 49 on the locking nut, so that the locking nut secures carton flap folding assembly 10 on framework 22 by locking lip 94 under flange 95 formed along the periphery of top end 96 of assembly mount 46. Assembly 10 is oriented in position on assembly mount 46 by positioning key 98, formed as a part of drive coupling 42, within key scot 99 of assembly mount 46.

The carton flap folding assembly is positioned along framework 22 of the packaging machine (not illustrated) in a fixed position with respect to the path of travel P of carton blank C as it moves past the carton flap folding assembly on the packaging machine. Shown in FIG. 1, a carton flap folding assembly 10 will be positioned on each side of path of travel P on framework 22 of the packaging machine, so that a carton flap folding assembly will engage each side of carton blank C for each group of bottles B as they travel along path P through the machine. This is done in order to ensure that there will be no lateral shifting of carton blank C with respect to path of travel P as star wheel assembly 29 and lugs 33 of lug belt 32 engage prescored flap areas F.

Referring to FIGS. 2, 3, and 7, locking nut 48 is slidably positioned on assembly mount 46 so that it moves vertically toward and away from drive shaft coupling 42.

As shown in FIG. 3, drive coupling 45 is driven by a right angle gear reducer 52, which is powered by a drive motor 53. Drive motor 53 can be any conventional electric motor, however, it is anticipated that drive motor 53 will be a servomotor having a feedback device (not illustrated) for precision control of carton flap folding assembly 10. It is anticipated that by using a servomotor as drive motor 53, star wheel assembly 29 and lug belt 32 of the assembly can be phased by drive motor 53 with respect to carton blanks C as they travel on path of travel P, and each carton flap folding assembly 10 can be phased with respect to carton blanks C independently of the other due to the ability to drive each servomotor separately with a high degree of control. It is anticipated that drive motor 53 will be tied into a digital control network (not illustrated), which would also include a computer (not illustrated) adapted to automatically control the operation of the packaging machine.

Figure 4:
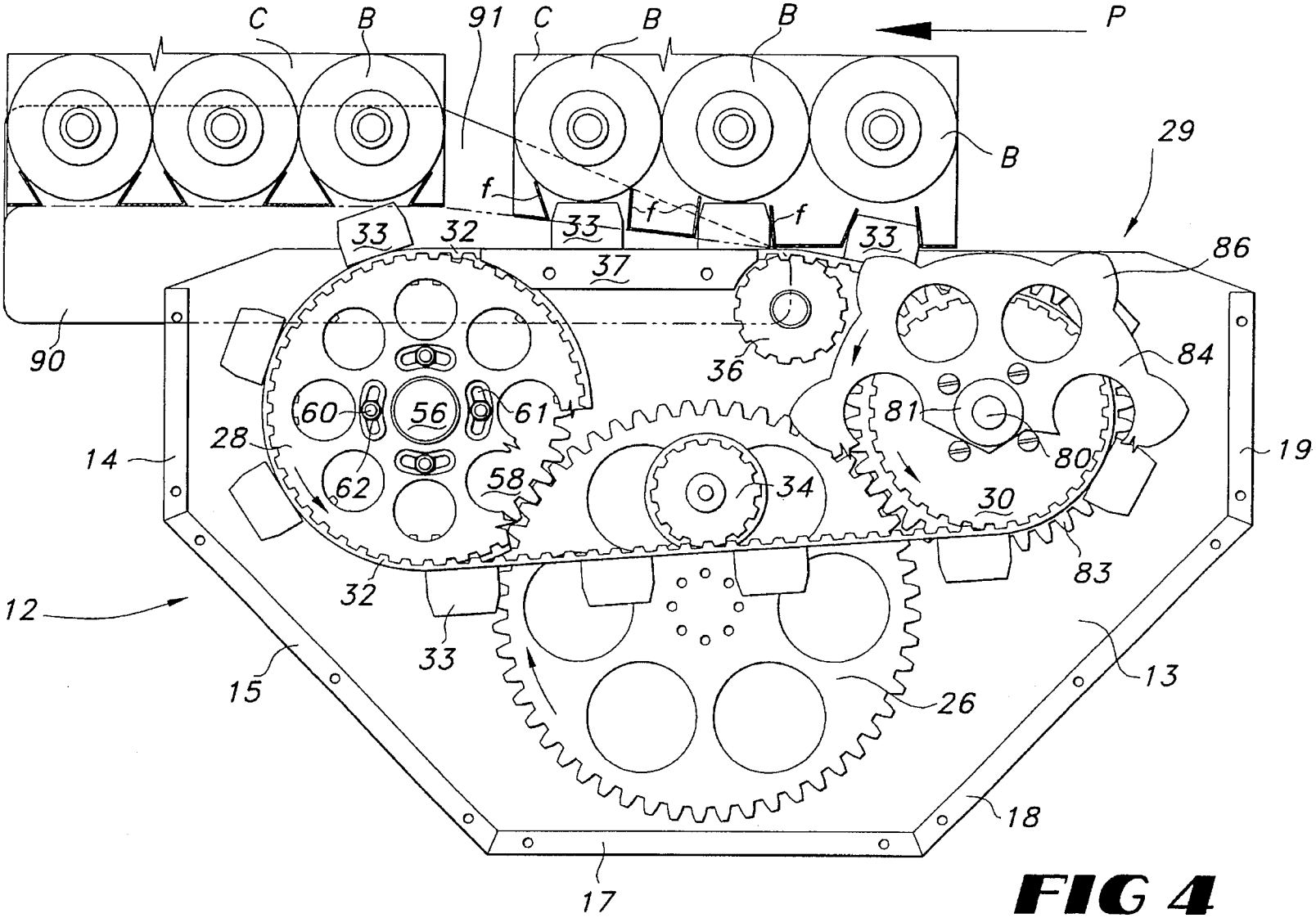
FIG. 4 is a top plan view of the carton flap folding assembly illustrated in FIG. 1.

Referring to FIG. 2, toothed drive pulley 28 is shown mounted to pulley drive gear 58 by bolts 62. Pulley drive gear 58 and drive pulley 28 both rotate on shaft 56 via bearing 57. As shown in FIG. 2, drive pulley shaft 56 is secured in position within housing 12 by a threaded fastener passed into each end of the pulley shaft through bottom plate 13 and top plate 21, respectively. Positioned on drive pulley shaft 56, spaced above bottom plate 13 and below drive pulley 28, is a pulley drive gear 58 which is engaged with drive gear 26, as best shown in FIG. 4. Pulley drive gear 58 is also supported for movement on shaft 56 by beatings 57. Referring now to FIG. 4, pulley drive gear 58 includes a plurality, here four, threaded studs or bolts 60 which extend upwardly through separate arcuate slotted openings 61 formed in drive pulley 28 for each bolt, on each of which a fastener 62 is received. When tightened, bolts 60 and fasteners 62 hold drive pulley 28 and pulley drive gear 58 together on shaft 56. So constructed, drive pulley 28 can be adjusted for phasing lug belt 32 independently of star wheel assembly 29. Fasteners 62 are loosened so that drive pulley 28 can be rotated with respect to drive pulley shaft 56 for the purposes of aligning lugs 33 with respect to star wheel teeth 86, whereupon fasteners 62 are tightened and drive pulley 28 is fixed with respect to drive pulley shaft 56, and the remainder of drive assembly 24.

Referring again to FIG. 2, belt tightening pulley 34 is illustrated in greater detail. The belt tightening pulley includes a shaft 64 having a collar 65 formed intermediate the ends of the shaft, collar 65 being adapted to fit against the inside surface of top plate 21. The end 66 of shaft 64 extending through top plate 21 is threaded and receives an adjustment nut 68 thereon. Threaded end 66 extends through a slotted opening 69, as shown in FIG. 1, so that the belt tightening pulley can be moved for the purpose of drawing slack out of lug belt 32 to ensure that the lug belt has the desired tension necessary to keep it positioned on drive pulley 28 as well as belt driven pulley 30. Belt tightening pulley 34 is rotatably supported on shaft 64 by roller bearing 70.

Idler pulley 36 is also illustrated in FIG. 2. Idler pulley 36 has a shaft 74 with a collar 75 formed intermediate the ends of the shaft, one end of shaft 74 being received within an opening (not illustrated) defined within top plate 21. It is anticipated that shaft 74 will be press fit into top plate 21. A roller beating 76 rotatably supports idler pulley 36 on shaft 74.

Star wheel assembly 29 is illustrated in FIGS. 2 and 3. As shown therein, the star wheel assembly includes a shaft 80 positioned within housing 12 with a threaded fastener passed through each end of shaft 80, and through bottom plate 13 and top plate 21, respectively, to position the shaft within the housing 12. Hub 81 is rotatably supported on shaft 80 by roller bearing assembly 82. A star wheel assembly drive gear 83 is formed as a part of hub 81, drive gear 83 being positioned above bottom plate 13 and below bottom star wheel disc 85. Top star wheel disc 84 and bottom star wheel disc 85 are parallel to and spaced apart from one another. Bottom disc 85 is fastened to hub 81 by threaded fasteners passed upward through the bottom of the hub and into the bottom disc. Top disc 84 is fastened to hub 81 by a plurality of fasteners passed through the top disc and into hub 81.

As described above, belt driven pulley 30 is positioned on shaft 80 and hub 81 of star wheel assembly 29, belt driven pulley 30 having a roller bearing assembly 31 so that the belt driven pulley can rotate freely on hub 81. So constructed, belt driven pulley 30 can rotate either faster or slower than the speed of rotation of hub 81 on shaft 80, the relative speed of star wheel assembly 29 and lug belt 32 being determined by the gearing ratio of pulley drive gear 58 and star wheel drive gear 83 with respect to drive gear 26.

Referring now to FIG. 4, carton blank folding assembly 10 is shown in top plan view with a portion of drive pulley 28 and top star wheel disc 84 cut away to show the manner in which drive pulley 28 and star wheel assembly 29 are driven in timed relationship with respect to one another by drive gear 26. As illustrated, drive gear 26 is engaged with the teeth of both pulley drive gear 58 and star wheel drive gear 83 so that as drive gear 26 is rotated, drive pulley 28 and star wheel assembly 29 will rotate in the opposite direction of drive gear 26. It is anticipated that for a carton blank path of travel as shown in FIG. 4, from right to left, that drive gear 26 will rotate in a clockwise direction so that drive pulley 28 and star wheel assembly 29 will rotate in a counterclockwise direction and thus star wheel assembly 29 and lugs 33 of lug belt 32 will also move in the direction of movement of carton blank C along path of travel P.

As also shown in FIG. 4, the teeth of lug belt 32 are engaged with the teeth defined along the outer circumference of toothed drive pulley 28, toothed belt driven pulley 30, as well as belt tightening pulley 34 and idler pulley 36. Lug belt 32 is guided along the path of travel P by lug belt guide 37 fastened to, and extending from, top plate 21 and extending toward bottom plate 13. Star wheel top disc 84, and star wheel bottom disc 85 are identical in configuration to each other, and have a spaced series of generally protruding teeth 86 adapted to be inserted through the prescored flap areas F of carton blank C for breaking flaps f open as the carton blank travels past carton flap folding assembly 10 along path of travel P. This is described in greater detail below with reference to FIGS. 5A through 5F. As belt driven pulley 30 is positioned intermediate top star wheel disc 84 and bottom star wheel disc 85, lug belt 32 is positioned intermediate the two star wheel discs, and lugs 33 emerge from between the top and bottom discs of the star wheel assembly and into the prescored flap areas F once they have been opened by a spaced pair of teeth 86 from the star wheel assembly.

As carton blank C proceeds along path of travel P, it engages top guide 90 and bottom guide 91, both of which are fastened to housing 12 of the carton flap folding assembly. As shown in FIGS. 3 and 4, top guide 90 and bottom guide 91 are constructed so that they extend outwardly away from housing 12 toward path of travel P and along the path of travel. As shown in FIG. 3, as the carton blank proceeds along the path of travel it engages top guide 90 and bottom guide 91 with the result that the sidewall of carton blank C is progressively moved toward each of bottles B until the carton blank sidewall is positioned in its final position as shown in the group of bottles B enclosed in carton blank $C_1$ farthest downstream along path of travel P with respect to carton flap folding assembly 10. This is also shown schematically in FIGS. 5A through 5F.

It is anticipated that lug belt 32 will be made of a durable elastomeric material, and that each of lugs 33 will be formed of a similar elastomeric material so that the lug belt has sufficient flexibility to pass over drive pulley 28, belt driven pulley 30, belt tightening pulley 34, idler pulley 36, and lug belt guide 37 without warping, twisting, or breaking. It is anticipated that lug belt 32, as well as lugs 33, may be reinforced with any number of natural or synthetic fibers, so that, for example, lug belt 32 could be a wire reinforced belt. Although shown as a flexible belt, it is anticipated that lug belt 32 could also be constructed as a chain belt, if so desired. This would require the modification of drive pulley 28, belt driven pulley 30, belt tightening pulley 34, and idler pulley 36 to include sprockets adapted to engage the chain, rather than teeth constructed to engage the teeth define along the inner periphery of lug belt 32.

The components of carton flap folding assembly 10 are otherwise conventional, and are conventionally constructed. It is anticipated that carton flap folding assembly 10, as well as its components, with the exception of lug belt 32 and lugs 33, will be constructed of a rigid and durable metallic material, although it is also anticipated that the carton flap folding assembly could be made of modern composite or plastic materials. Each of beating assemblies 31, 41, 57, 70, 76, and 82 are shown as roller bearings, however as is known to those skilled in the art, these bearing assemblies could just as well be needle bearings or any other suitable bearing adapted for use in high speed processing operations.

OPERATION

The operation of carton flap folding assembly 10 is best explained by reference to FIGS. 5A through 5F, in which the operation of the flap folding assembly is schematically illustrated.

Figure 5B:
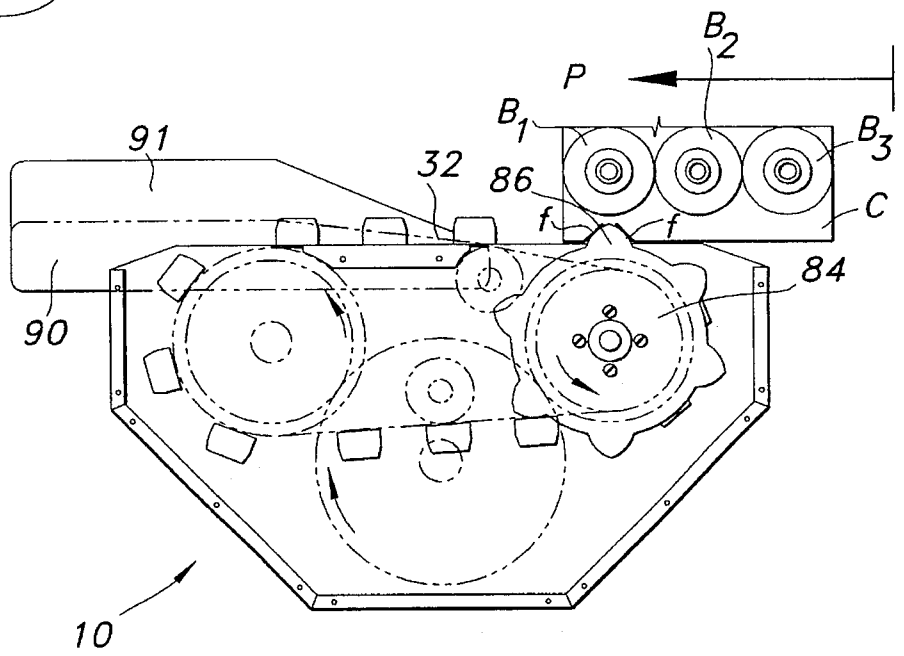
FIGS. 5A through 5F are schematic plan views of the embodiment of FIG. 1 in the various stages of engagement with a carton blank.
Figure 5A:
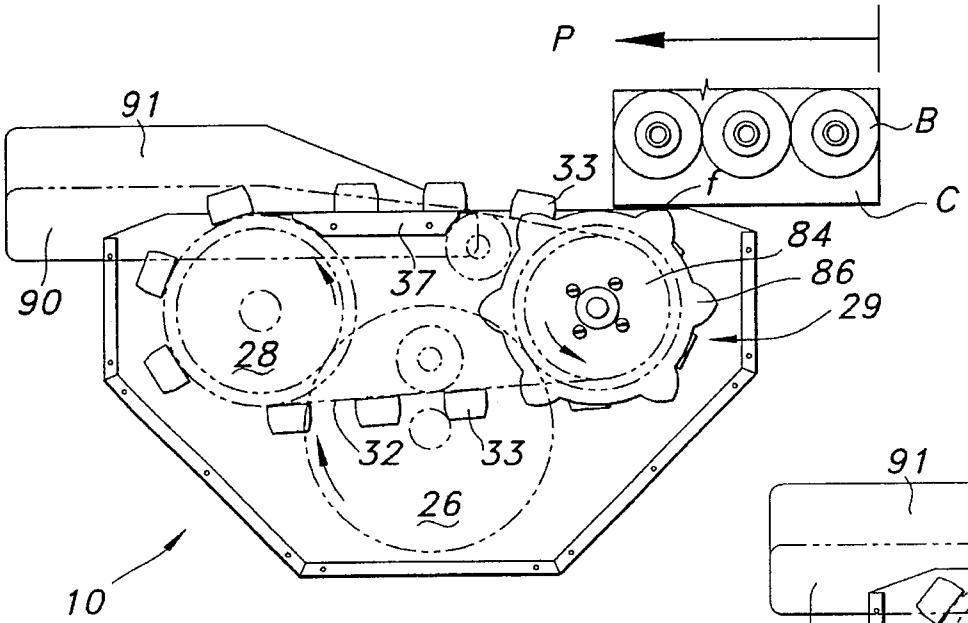

Turning first to FIG. 5A, carton blank C, placed on a group of bottles B, is shown moving along path of travel P of the packaging machine (not illustrated) from an infeed station (not illustrated) toward an outfeed station (not illustrated). For the purposes of discussion herein, only one-half of bottle group B is shown, the bottle group being cut in half along its longitudinal axis. As shown in FIG. 1, a carton flap folding assembly 10 is positioned on each side of path of travel P, and engages each side, respectively, of carton blank C and group of bottles B as it travels along path of travel P.

Still referring to FIG. 5A, carton flap folding assembly 10 is positioned along the path of travel so that carton blank C passes in spaced relationship to the carton flap folding assembly. Drive gear 26 of the assembly is rotating in the clockwise direction shown, thus ensuring that drive pulley 28 and star wheel assembly 29 are each rotating in a counterclockwise direction, so that a spaced pair of star wheel teeth 86 of top star wheel disc 84 and bottom star wheel disc 85 (not illustrated), as well as lug belt 32 and lugs 33 thereon, are moving in the same lateral direction as carton blank C along the path of travel P.

In FIG. 5A carton blank C is shown as it first arrives at carton flap folding assembly 10. A spaced pair of teeth 86 has been rotated toward prescored flap area F, but the carton flap folding assembly has not yet engaged carton blank C. As the carton blank C continues to travel along path of travel P, as shown in FIG. 5B, a pair of teeth 86 break flaps f of the first prescored flap area F open, pushing flaps f inwardly toward the first bottle $B_1$ within the group of bottles B.

Figure 5D:
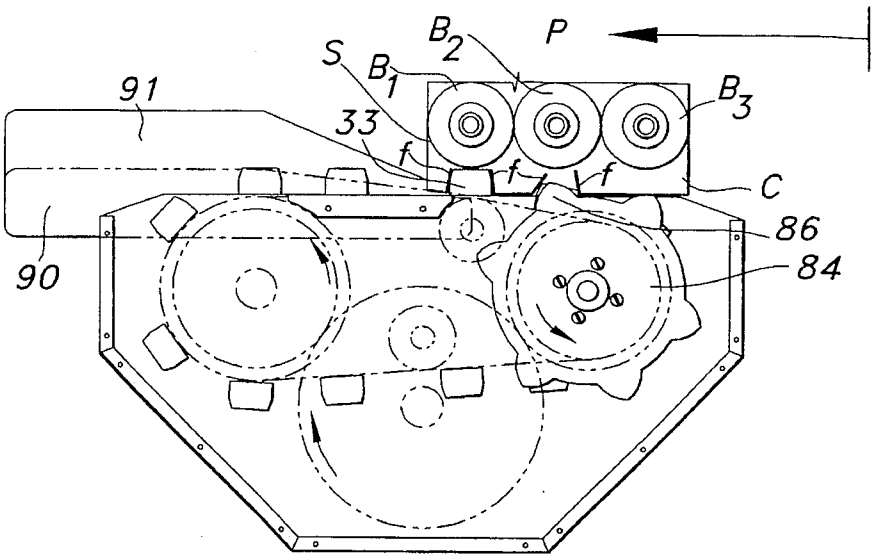
Figure 5C:
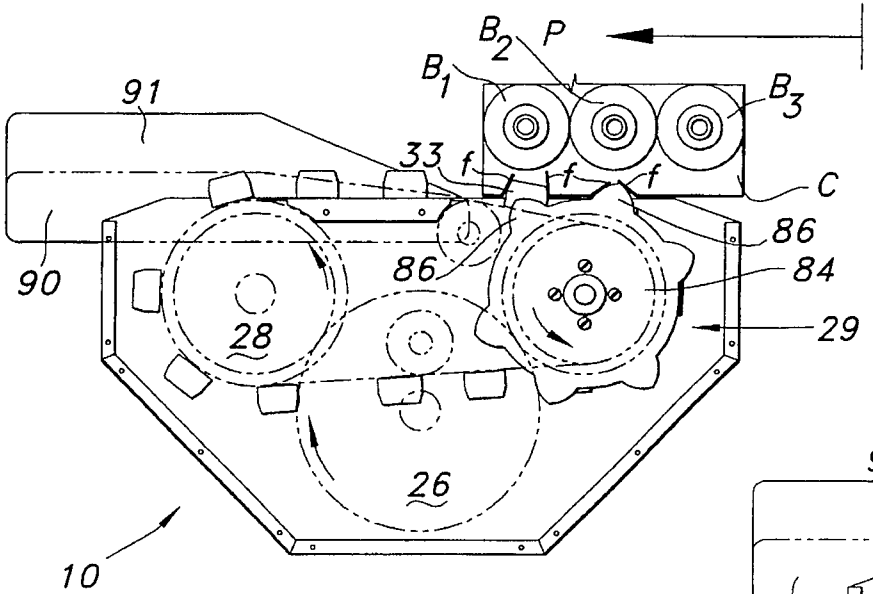

Once teeth 86 have broken prescored flap area F open, a first lug 33 is inserted into the carton blank therethrough and is passed toward first bottle $B_1$, flaps f riding along the exterior surface of lug 33 as it is moved toward engagement with the exterior surface S of bottles $B_1$, shown in FIGS. 5C and 5D.

Referring now to FIGS. 5C and 5D, once the first lug 33 has engaged the exterior surfaces of bottle B, a second pair of teeth 86 has broken open the flaps f of the second prescored flap area F, and a second lug 33 is shown extending into the prescored flap area, pushing flaps f inwardly open toward the second bottle $B_2$ within the group of bottles. As also shown in FIGS. 5C and 5D, the sidewall of carton blank C has begun to engage top guide 90 and bottom guide 91, and is now being moved toward the group of bottles as the carton blank travels along the path of travel P.

Figure 5E:
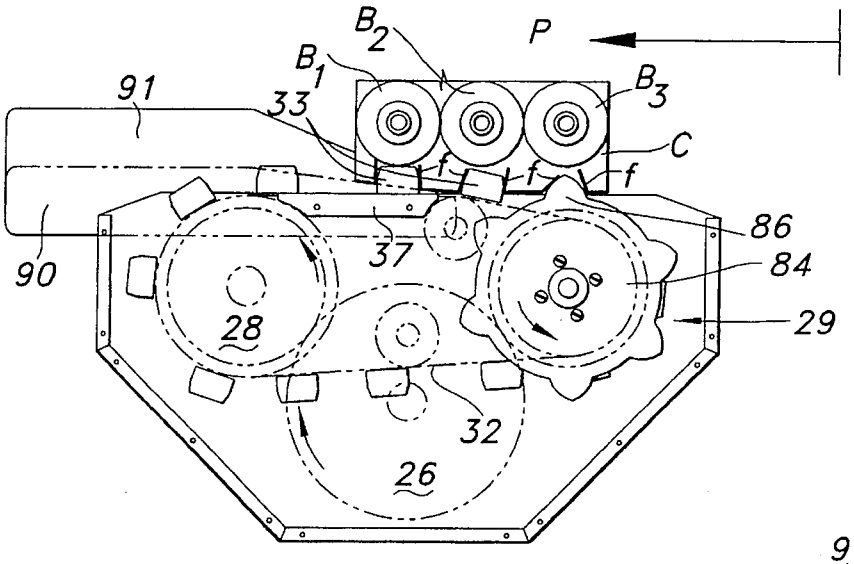

In FIG. 5E a third pair of star wheel teeth 86 is shown breaking open the flaps f of a third prescored flap area F for the third bottle $B_3$ within the group of bottles. The first lug 33 is engaged with the surface S of the first bottle B, flaps f being moved into tangential engagement with the exterior surfaces of the bottle without any kind of mechanism formed as a part of lug 33 being used to actuate or move flaps f into a second or "open" position with respect to bottle $B_1$. A second lug 33 is shown moving toward the exterior surface S of bottle $B_2$ within the group of bottles, flaps f traveling along the exterior surface of the lug toward the exterior surface S of the bottle. As shown on FIG. 5E, that portion of the carton blank sidewall which is engaged on top guide 90 and bottom guide 91 continues to be moved toward bottle $B_1$.

Figure 5F:
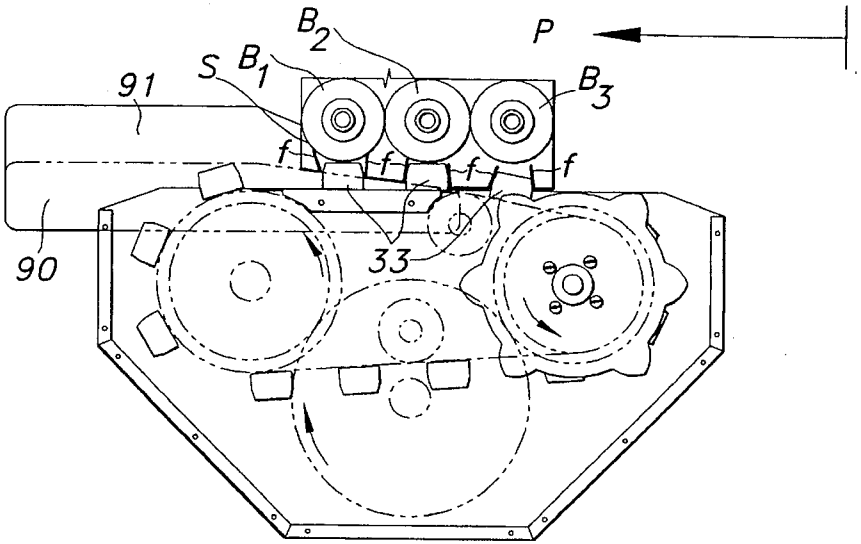

In FIG. 5F, the third pair of teeth 86 have been withdrawn from the carton blank, and flaps f are now riding along the exterior surface of a third lug 33 after it has been moved through the prescored flap area and toward the exterior surfaces of the third bottle $B_3$ within the group of bottles. First lug 33 is still positioned against the exterior surface of bottle B, the lug being held in position with respect to the bottle by lug belt guide 37. Flaps f of the first prescored flap area are being moved tangentially across the exterior surface S of bottle $B_1$ as the sidewall carton blank C is moved toward the bottle by top guide 90 and bottom guide 91. In similar fashion, flaps f for the second bottle $\mathbf{13}_2$ are beginning to be moved into tangential engagement with the exterior surface S of the second bottle $B_2$ as second lug 33 is now supported by lug belt guide 37 with respect to bottle $B_2$. The third lug 33 is moving at an angle with respect to the path of travel P, toward idler pulley 36 (FIGS. 4 and 5F) and lug belt guide 37, whereupon flaps f will be moved along the exterior surface of this third lug 33 toward and into tangential engagement of the exterior surface S of the third bottle $B_3$. Although not shown in greater detail herein, the identical sequence of steps is occurring on the opposite side of carton blank C for that portion of the group of bottles B not shown in FIGS. 5 A–5F, with a second carton flap folding assembly 10 as shown generally in FIG. 1.

Referring now to FIG. 4, a carton blank $C_1$ is shown moving along path of travel P with all of flaps f moved into their open position with respect to each of the bottles within the group of bottles. The carton blank sidewall is held in position with respect to each of the bottles by top guide 90 and bottom guide 91, a similar series of guides (not illustrated) being provided downstream as a part of the packaging machine (not illustrated) so that locking tabs L (FIG. 1) are moved into a slot or aperture (not illustrated) formed in the matching bottom flap of carton blank $C_1$, whereupon the carton blank will be sealed around the group of bottles.

So constructed, carton flap folding assembly 10 presents a highly simplified, and novel, method and apparatus for moving the flaps f of the prescored flap areas F into an open position with respect to each bottle within the group of bottles without using any kind of pivoting finger or lever mounted on the end of lugs 33. The opening of flaps f for the purpose of locking each of the bottles within the group of bottles B in position within carton blank C, a paperboard carrier, is accomplished by first introducing a pair of spaced teeth 86 from top star wheel disc 84 and bottom star wheel disc 85 (FIG. 3) into the prescored flap area for the purposes of breaking flaps f open. Thereafter, a lug 33 is inserted into the prescored flap area prior to withdrawing teeth 86 of the star wheel discs. Lugs 33 are positioned with respect to each of the bottles and engage the exterior surface of each bottle, respectively, as the lugs ride along lug belt guide 37.

As lug 33 is traveling in the direction of the path of travel, along with carton blank C and group of bottles B, top guide 90 and bottom guide 91 are simultaneously moving the side wall of carton blank C toward the bottles, so that flaps f are guided along the outside of each lug 33 into tangential engagement with the exterior surface S of each bottle, the flaps then being moved into an open or locked position with respect to each bottle as the carton blank side wall is moved into its final position, as shown in carton blank $C_1$ of FIG. 4.

This method, and apparatus, are thus particularly well suited to high speed operations due to the simplicity of its construction and mode of operation which does not require a large number of mechanical parts to accomplish the folding of flaps f.

While a preferred embodiment of the invention has been disclosed in the foregoing specification, it is understood by those skilled in the art that variations and modifications thereof can be made without departing from the spirit and scope of the invention, as set forth in the following claims. In addition, the corresponding structures, materials, acts, and equivalents of all means or step plus function elements in the claims below are intended to include any structure, material, or acts for performing the functions in combination with other claimed elements as specifically claimed.

I claim:

1. A method of folding the flaps of a packaging carton blank about a group of bottles having an exterior surface, the carton blank and the group of bottles being conveyed through a packaging machine along a path of travel, the carton blank having at least one prescored flap area formed in a side wall of the carton blank with respect to each bottle within the group of bottles, said method comprising the steps of:

(a) positioning a carton flap folding assembly along the path of travel so that the carton blank passes in spaced relationship to said folding assembly as the carton blank is conveyed along the path of travel, said folding assembly including engagement means for engaging the carton blank;

(b) inserting said engagement means into the carton blank through the prescored flap area and moving the flaps of the prescored flap area inwardly toward one of the bottles within the group of bottles;

(c) moving the side wall of the carton blank toward the group of bottles;

(d) guiding the flaps of the prescored flap area into tangential engagement with the exterior surface of the bottle with said engagement means;

(e) opening the flaps of the prescored flap area by moving the flaps tangentially across the exterior surface of the bottle; and (f) withdrawing said engagement means from the carton blank.

2. The method of claim 1, further comprising the step of sequentially repeating steps (b) through (f) for each bottle within the group of bottles as the group of bottles is moved along the path of travel past said folding assembly.

3. The method of claim 1, wherein step (d) comprises the step of engaging the exterior surface of the bottle with said engagement means and moving the flaps of the prescored flap area along the engagement means toward the bottle.

4. An apparatus for folding the flaps of a packaging carton blank about a group of bottles having an exterior surface, the carton blank and the group of bottles being moved on a conveyor line through a packaging machine and along a path of travel, the carton blank having a prescored flap area formed in a side wall of the carton blank with respect to and for each bottle within the group of bottles, said apparatus comprising:

a carton flap folding assembly positioned along the path of travel in a spaced relationship with the carton blank as the carton blank is conveyed along the path of travel, said folding assembly including engagement means for engaging the carton blank;

said engagement means being constructed and arranged to be inserted into the carton blank through the prescored flap area, to move the flaps of the prescored flap area inwardly toward one of the bottles within the group of bottles, and to guide the flaps of the prescored flap area into tangential engagement with the exterior surface of the bottle; and means for moving the side wall of the carton blank toward the group of bottles;

whereby said engagement means is inserted into the carton blank through the prescored flap area formed in the side wall of the carton blank, the engagement means guiding and opening the flaps of the prescored flap area inwardly and into tangential engagement with the exterior surface of the bottle, the flaps being moved into an open position within the carton blank by being passed tangentially across the exterior surface of the bottle while the side wall of the carton blank is being moved toward the group of bottles, whereupon the engagement means is withdrawn from the carton blank.

5. The apparatus of claim 4, further comprising means for moving said engagement means along the path of travel with the carton blank as the carton blank is moved along the path of travel past said folding assembly.

6. The apparatus of claim 5, said apparatus comprising a drive means for driving said engagement means and said means for moving in a timed relationship with respect to one another.

7. A method of folding the flaps of a packaging carton blank about a group of bottles having an exterior surface, the carton blank and the group of bottles being conveyed through a packaging machine and along a path of travel, the carton blank having at least one prescored flap area formed in a side wall of the carton blank with respect to each bottle within the group of bottles, said method comprising the steps of:

(a) positioning a carton flap folding assembly along the path of travel so that the carton blank passes in spaced relationship to said folding assembly as the carton blank is conveyed along the path of travel, said folding assembly including engagement means for engaging the carton blank;

(b) sequentially inserting said engagement means into the carton blank through each prescored flap area and inwardly moving the flaps of the prescored flap areas inwardly toward each one of the bottles within the group of bottles;

(c) moving the side wall of the carton blank toward the group of bottles;

(d) guiding the flaps of each prescored flap area into tangential engagement with the exterior surface of each bottle, respectively, with said engagement means;

(e) opening the flaps of each prescored flap area by moving the flaps tangentially across the exterior surface of each bottle, respectively; and (f) sequentially withdrawing said engagement means from the carton blank as it moves along the path of travel.

8. The method of claim 7, said engagement means including a star wheel assembly having a spaced series of protruding teeth and a lug belt having a spaced series of protruding lugs, wherein step (b) comprises the steps of inserting one of the teeth of the star wheel assembly into the carton blank through each prescored flap area and then inserting one of the lugs of the lug belt into the carton blank through each prescored flap area.

9. The method of claim 8, comprising the step of moving the lugs of said lug belt into engagement with the exterior surface of each bottle, respectively, within the group of bottles.

10. The method of claim 8, wherein step (b) further comprises the step of withdrawing the teeth of said star wheel from the carton blank and leaving the lugs of said lug belt inserted within the carton blank.

11. The method of claim 7, wherein step (c) comprises the step of continuously moving the side wall of the carton blank toward the group of bottles as the carton blank is moved along the path of travel past said folding assembly.

12. The method of claim 7, wherein step (d) comprises the step of engaging the exterior surface of each of the bottles within the group of bottles with said engagement means and moving the flaps of the prescored flap area along the engagement means toward the bottle.

13. A method of folding the flaps of a packaging carton blank about a group of bottles having and exterior surface, the carton blank having a prescored flap area formed in a side wall of the carton blank with respect to and for each bottle within the group of bottles, said method comprising the steps of:

(a) conveying the carton blank and the group of bottles through a packaging machine along a path of travel;

(b) positioning a carton flap folding assembly having engagement means for engaging the carton blank along the path of travel so that the carton blank passes in spaced relationship to said folding assembly as it is conveyed along the path of travel;

(c) inserting said engagement means into the carton blank through the prestored flap areas and moving the flaps thereof toward the group of bottles;

(d) moving the carton blank side wall toward the group of bottles;

(e) guiding the flaps of each prescored flap area toward the group of bottles with said engagement means;

(f) positioning the flaps of each prescored flap area tangentially on the exterior surface of one each of the bottles in the group of bottles by opening the flaps of each prescored flap area by moving the flaps thereof tangentially across the exterior surface each bottle positioned with respect to each prescored flap area within the group of bottles; and (g) withdrawing said engagement means from the carton blanks.

14. A method of folding the flaps of a packaging carton blank about a group of generally aligned bottles having an exterior surface, the carton blank and the group of bottles being conveyed through a packaging machine along a path of travel, the carton blank having a side wall and a prescored flap area formed in the side wall with respect to and for each bottle within the group of bottles, said method comprising the steps of:

(a) positioning a carton flap folding assembly having first and second engagement means for engaging the carton blank along the path of travel so that the carton blank passes in spaced relationship to said folding assembly as the carton blank is moved along the path of travel;

(b) inserting said first engagement means into said carton blank through one of the prescored flap areas and moving the flaps thereof toward the group of bottles;

(c) inserting said second engagement means into said carton blank through the prescored flap area;

(d) withdrawing said first engagement means from said carton blank;

(e) moving the carton blank side wall toward the group of bottles;

(f) guiding the flaps of the prescored opening toward one of the bottles within the group of bottles with said second engagement means;

(g) tangentially positioning the flaps of the prescored flap area on the exterior surface of the bottle; and (h) withdrawing said second engagement means from the carton blank.

15. The method of claim 14, further comprising the step of sequentially repeating steps (b) through (h) for each bottle within the group of bottles as the group of bottles is moved past said folding assembly.

16. The method of claim 14, wherein step (g) includes the step of opening the flaps of the prescored flap area positioned with respect to the bottle by moving the flaps tangentially across the exterior surface of the bottle.

17. An apparatus for folding the flaps of a packaging carton blank about a group of generally aligned bottles having an exterior surface, the carton blank and the group of bottles being moved along a conveyor line through a packaging machine and along a path of travel, the carton blank having a side wall and a prescored flap area formed in the side wall with respect to and for each bottle within the group of bottles, said apparatus comprising:

a carton flap folding assembly positioned adjacent the path of travel and fixed in position with respect to the carton blank, said folding assembly having a first and a second engagement means for sequentially engaging the prescored flap areas of the carton blank as the carton blank is moved along the path of travel;

said first engagement means comprising a star wheel assembly having at least one star wheel disc with a spaced series of generally protruding lugs constructed and arranged to be inserted through the prescored flap areas and into the carton blank;

said second engagement means comprising a spaced series of lugs positioned along and protruding from an endless lug belt;

means for driving said first engagement means and said second engagement means in timed relationship with respect to one another;

means, positioned along the path of travel, for moving the carton blank side wall toward the group of bottles;

said second engagement means being sized and shaped to guide the flaps of the prescored flap area toward and into tangential engagement with the exterior surface of the bottles within the group of bottles;

wherein the flaps of the prescored flap area are passed tangentially across the exterior surface of the bottle and moved into an open position within the carton blank as the side wall of the carton blank is moved toward the group of bottles.

18. The apparatus of claim 17, wherein said star wheel assembly comprises:

a hub rotatably supported within said folding assembly, said hub including a star wheel drive gear formed as a part thereof; and a pair of spaced, generally parallel, and aligned star wheel discs mounted on said hub.

19. The apparatus of claim 18, wherein said second engagement means further comprises:

a drive pulley rotatably supported within said folding assembly, said drive pulley including a pulley drive gear formed as a part thereof;

a belt driven pulley rotatably mounted on said star wheel assembly hub and positioned thereon intermediate said star wheels, said belt driven pulley being constructed and arranged to rotate independently of said star wheel hub;

wherein said lug belt is positioned on said drive pulley and said belt driven pulley, the lug belt being generally parallel to the path of travel of the carton blank.

20. The apparatus of claim 19, wherein said means for driving said first engagement means and said second engagement means comprises a drive gear rotatably supported within said folding assembly, said drive gear being commonly engaged with both said pulley drive gear and said star wheel drive gear.

21. The apparatus of claim 17, said folding assembly including a lug belt guide constructed and arranged to position said lug belt parallel to the path of travel and spaced with respect to the carton blank.

22. A packaging machine for folding the flaps of a packaging carton blank about a group of bottles having an exterior surface, as the carton blank and the group of bottles are moved on a conveyor line through the packaging machine and along a path of travel, the carton blank having a prescored flap area formed in a side wall of the carton blank with respect to and for each bottle within the group of bottles, said packaging machine comprising:

a packaging machine framework;

a modular carton flap folding assembly;

means for positioning said folding assembly on said framework along the path of travel in a spaced relationship with the carton blank as the carton blank is conveyed along the path of travel;

said folding assembly including an engagement means for engaging the carton blank, said engagement means being constructed and arranged for insertion into the carton blank through the prescored flap area, for moving the flaps of the prescored flap area inwardly toward one of the bottles within the group of bottles, and for guiding the flaps of the prescored flap area into tangential engagement with the exterior surface of the bottle;

means for moving the side wall of the carton blank toward the group of bottles;

wherein said engagement means is inserted into the carton blank through the prescored flap area formed in the side wall of the carton blank, said engagement means guiding and opening the flaps of the prescored flap area inwardly and into tangential engagement with the exterior surface of the bottle, the flaps being moved into an open position within the carton blank by being passed tangentially across the exterior surface of the bottle while the side wall of the carton blank is being moved toward the group of bottles, said engagement means then being withdrawn from the carton blank.

23. The apparatus of claim 22, further comprising a means for moving said engagement means along the path of travel within the carton blank as the carton blank is being moved along the path of travel past said folding assembly.

24. The apparatus of claim 22, wherein said modular carton flap folding assembly comprises:

a housing having a planar and generally horizontal bottom wall;

a drive shaft coupling mounted on said bottom wall and extending away therefrom;

said framework including an assembly mount positioned on said framework, said assembly mount including a locking nut threadably received on said assembly mount, said locking nut being sized and shaped to receive said drive shaft coupling therein and to be moved along said assembly mount toward and away from said framework and for locking said drive shaft coupling to said assembly mount;

wherein said means for positioning said folding assembly on said framework comprises:

a key positioned on said drive shaft coupling;

a key slot define within said assembly mount, said key slot being sized and shaped to receive said key therein;

said assembly mount having a top end spaced from said framework and including a flange formed along at least a portion of the periphery thereof;

said drive shaft coupling including an annular lip formed along at least a portion of the periphery thereof, said lip being constructed and arranged to be received on said flange;

so that said folding assembly is positioned on said framework by fitting said key within said key slot while the flange of the assembly mount holds the lip of the drive shaft coupling as said locking nut is moved along said assembly mount to lock said folding assembly into position on said framework.

* * * * *